US006295908B1

(12) United States Patent
Holzhauser et al.

(10) Patent No.: US 6,295,908 B1
(45) Date of Patent: Oct. 2, 2001

(54) SELECTIVELY VARIABLE HOLE PUNCHING DEVICE

(75) Inventors: Ronald C. Holzhauser, Williamsburg, VA (US); Charles A. Moore, Bartlett, TN (US)

(73) Assignee: Canon Virginia, Inc., Newport News, VA (US)

( * ) Notice: Subject to any disclaimer, the term of this patent is extended or adjusted under 35 U.S.C. 154(b) by 0 days.

(21) Appl. No.: 09/466,194

(22) Filed: Dec. 17, 1999

(51) Int. Cl.[7] ..... B26D 5/20; B26D 1/56; B26D 5/40

(52) U.S. Cl. ..... 83/76.9; 83/370; 83/334; 83/669

(58) Field of Search ..... 83/334, 335, 667, 83/678, 699, 524, 525, 553, 556, 557, 559, 564, 76.9, 684, 30, 370, 234, 551, 669

(56) References Cited

U.S. PATENT DOCUMENTS

| | | | | |
|---|---|---|---|---|
| 685,400 | * | 10/1901 | Hayes | 83/553 |
| 734,496 | * | 7/1903 | Ames | 83/559 |
| 1,002,296 | | 9/1911 | McPike et al. . | |
| 1,466,001 | | 8/1923 | Metzner et al. . | |
| 1,808,500 | | 6/1931 | Holny . | |
| 3,064,513 | * | 11/1962 | Hershey | 83/553 |
| 3,650,446 | * | 3/1972 | Samluk | 83/678 |
| 4,724,734 | * | 2/1988 | Hse | 83/549 |
| 5,239,904 | * | 8/1993 | Yamaguchi et al. | 83/684 |
| 5,669,277 | * | 9/1997 | Perrone | 83/553 |
| 5,746,162 | * | 5/1998 | Hosoi et al. . | |
| 5,797,305 | | 8/1998 | Harrod et al. . | |
| 5,842,401 | | 12/1998 | Hart . | |
| 5,887,502 | * | 3/1999 | Yamaguchi et al. . | |
| 5,911,414 | * | 6/1999 | Kato et al. | 83/684 |
| 6,014,920 | * | 1/2000 | Yamauchi et al. . | |
| 6,065,379 | * | 5/2000 | Shinno et al. | 83/30 |
| 6,065,383 | * | 5/2000 | Takaishi et al. | 83/370 |

* cited by examiner

*Primary Examiner*—Rinaldi I. Rada
*Assistant Examiner*—Thomas J. Druan, Jr.
(74) *Attorney, Agent, or Firm*—Fitzpatrick, Cella, Harper & Scinto

(57) ABSTRACT

An apparatus for forming a number of holes in a medium includes a selector, a hole forming device and a controller. The selector selects the number of holes to be formed in the medium, with the number of holes being selected from at least two predetermined numbers such as two and three. The hole forming device forms the holes in the medium. The controller controls the hole forming device to form in the medium the number of holes selected by the selector.

19 Claims, 3 Drawing Sheets

SELECTIVELY VARIABLE HOLE PUNCHING DEVICE

BACKGROUND OF THE INVENTION

1. Field of the Invention

The present invention relates to an apparatus for forming holes in a medium. More particularly, the invention relates to an automated apparatus for selectively forming a desired number of holes in the medium.

2. Description of Related Art

Documentation, such as paper sheets, often require holes punched therein for subsequent filing. For example, three ring binders are commonly used to retain 8½×11 size paper. These binders require three holes of predetermined spacing formed in the left margin of the paper to be stored therein. Two and five ring binders are also known. On the other hand, legal size (11×14) paper is commonly retained by two rings or pins inserted through two holes formed in the top margin of the medium.

Manual or automated hole punching machines are wellknown for forming such holes in media. Typically, one or more sheets of paper are placed in these machines and the operator either manipulates a lever or presses a button to cause punching studs to cut through the paper and form the holes. Because the spacing between holes in standard two-hole and three-hole formats differs, certain manual hole punching machines allow the position of at least one punch to be adjusted to permit punching in either format. Typically, such adjustment is a tedious, time-consuming process that includes loosening clamps holding the punch in position, sliding the movable punch to the desired position and retightening the clamps. Switching between two- and three-hole punching in certain automated machines is much simpler, merely requiring the sliding of a switch. In some models, the switch also functions as a paper guide, the position of which differs depending on the size of the paper to be punched.

When the paper to be punched has an image formed thereon by a printer or a copier, an operator would typically remove the recorded paper from the discharge tray or sorter of the printer or copier, carry it to a separate punching machine and effect the punching process. In order to eliminate a number of steps in forming printed media with holes punched therein, it has been proposed to incorporate an automated hole punching mechanism disposed before or after the sorter or discharge tray in the medium conveying path of a printer or copier, for example. However, these apparatuses cannot readily switch between forming different numbers of holes in the recorded media. That is, the punching mechanism has to be reconfigured if three holes are to be formed in the discharged media rather than two holes, for example.

SUMMARY OF THE INVENTION

It is, therefore, an object of the present invention to provide an automated hole forming apparatus that can selectively form a desired number of holes in media.

It is another object of the present invention to selectively form a desired number of holes in media without reconfiguring the apparatus.

A still further object of the present invention is to incorporate a selectively operable hole forming device into an image forming apparatus or an input or output accessory to the image forming apparatus, such as a sorter.

Yet another object of the present invention is to provide an image forming apparatus with a selectively operable hole forming device that will not delay the throughput of the image forming apparatus.

In one aspect of the present invention, an apparatus for forming a number of holes in a medium includes a punching unit, a selector and a controller. The punching unit forms the holes in the medium and includes a punching roller having at least first and second sets of aligned punching studs and a parallel die roller having at least first and second sets of aligned recesses complementary to the first and second sets of punching studs, respectively, with the first set of punching studs numbering a first predetermined number and the second set of punching studs numbering a second predetermined number. The selector selects whether to form the first predetermined number or the second predetermined number of holes in the medium. The controller controls the punching unit based on the number of holes selected by the selector. The controller controls the punching roller and the die roller to rotate with the first set of punching studs engaging the first set of recesses through the medium to form the first predetermined number of holes in the medium when the first predetermined number is selected, and to rotate with the second set of punching studs engaging the second set of recesses through the medium to form the second predetermined number of holes in the medium when the second predetermined number is selected.

In another aspect of the present invention, an apparatus for selectively forming a number of holes in a medium includes a punching unit, a selector, a conveyor, a sensor and a controller. The punching unit forms the holes in the medium and includes a punching roller having one punching stud and a parallel die roller having a complementary recess. The selector selects a predetermined number of holes to be formed in the medium. The conveyor conveys the medium through the punching unit. The sensor detects a position of the medium. The controller controls the conveyor and the punching unit based on the predetermined number of holes selected by the selector and an output of the sensor. The controller controls the punching roller and the die roller to rotate with the punching stud engaging the recess through the medium to form a first hole of the predetermined number of holes at a first location in the medium after the conveyor conveys the medium a first predetermined distance from where said sensor has sensed the position of the medium, and controls the punch roller and the die roller to rotate with the punching stud engaging the recess through the medium to form a second hole in the medium after the conveyor conveys the medium a second predetermined distance from the first location where the first hole is formed.

In another aspect of the present invention, an apparatus for forming a number of holes in a medium includes selecting means, hole forming means and control means. The selecting means selects the number of holes to be formed in the medium, the number of holes being selected from at least two predetermined numbers. The hole forming means forms the holes in the medium. The control means controls the hole forming means to form in the medium the number of holes selected by the selecting means.

In still another aspect of the present invention, an apparatus for selectively forming a number of holes in a medium includes punching means, selecting means, conveying means, sensing means and controlling means. The punching means forms the holes in the medium. The selecting means selects a predetermined number of holes to be formed in the medium. The conveying means conveys the medium through the punching means. The sensing means detects a position of the medium. The controlling means controls the conveying means and the punching means based on the predetermined number of holes selected by the selecting means and an output of the sensing means. The controlling means controls the punching means to form a first hole of the predetermined number of holes at a first location in the medium after the conveying means conveys the medium a first predetermined distance from where the sensing means has sensed the position of the medium, and controls the punching means to form a second hole in the medium after the conveying means conveys the medium a second predetermined distance from the first location where the first hole is formed.

In a still further aspect of the present invention, an apparatus for forming a number of holes in a medium includes a punching section, a selector and a controller. The punching section forms the holes in the medium and includes a punching device having at least first and second sets of aligned punches. The first set of punches numbers a first predetermined number and the second set of punches numbers a second predetermined number. The selector selects whether to form the first predetermined number or the second predetermined number of holes in the medium. The controller controls the punching section based on the number of holes selected by the selector. The controller controls the punching section to force the first set of punches through the medium to form the first predetermined number of holes in the medium when the first predetermined number is selected, and to force the second set of punches through the medium to form the second predetermined number of holes in the medium when the second predetermined number is selected.

In yet a further aspect of the present invention, an apparatus for selectively forming a number of holes in a medium includes a punching section, a selector, a conveyor, a sensor and a controller. The punching section forms the holes in the medium and includes one punch. The selector selects a predetermined number of holes to be formed in the medium. The conveyor conveys the medium in a conveying direction through the punching section. The sensor is disposed upstream of the punching section in the conveying direction and detects a leading edge of the medium. The controller controls the conveyor and the punching section based on the predetermined number of holes selected by the selector and an output of the sensor. The controller controls the punching section to force the punch through the medium to form a first hole of the predetermined number of holes at a first location in the medium after the conveyor conveys the medium a first predetermined distance from where the sensor has sensed the leading edge of the medium, and controls the punching section to force the punch through the medium to form a second hole in the medium after the conveyor conveys the medium a second predetermined distance from the first location where the first hole is formed.

These and other objects, aspects, features and advantages of the present invention will become apparent from the following detailed description of the preferred embodiments taken in conjunction with the accompanying drawings.

DETAILED DESCRIPTION OF THE PREFERRED EMBODIMENTS

Figure 1:
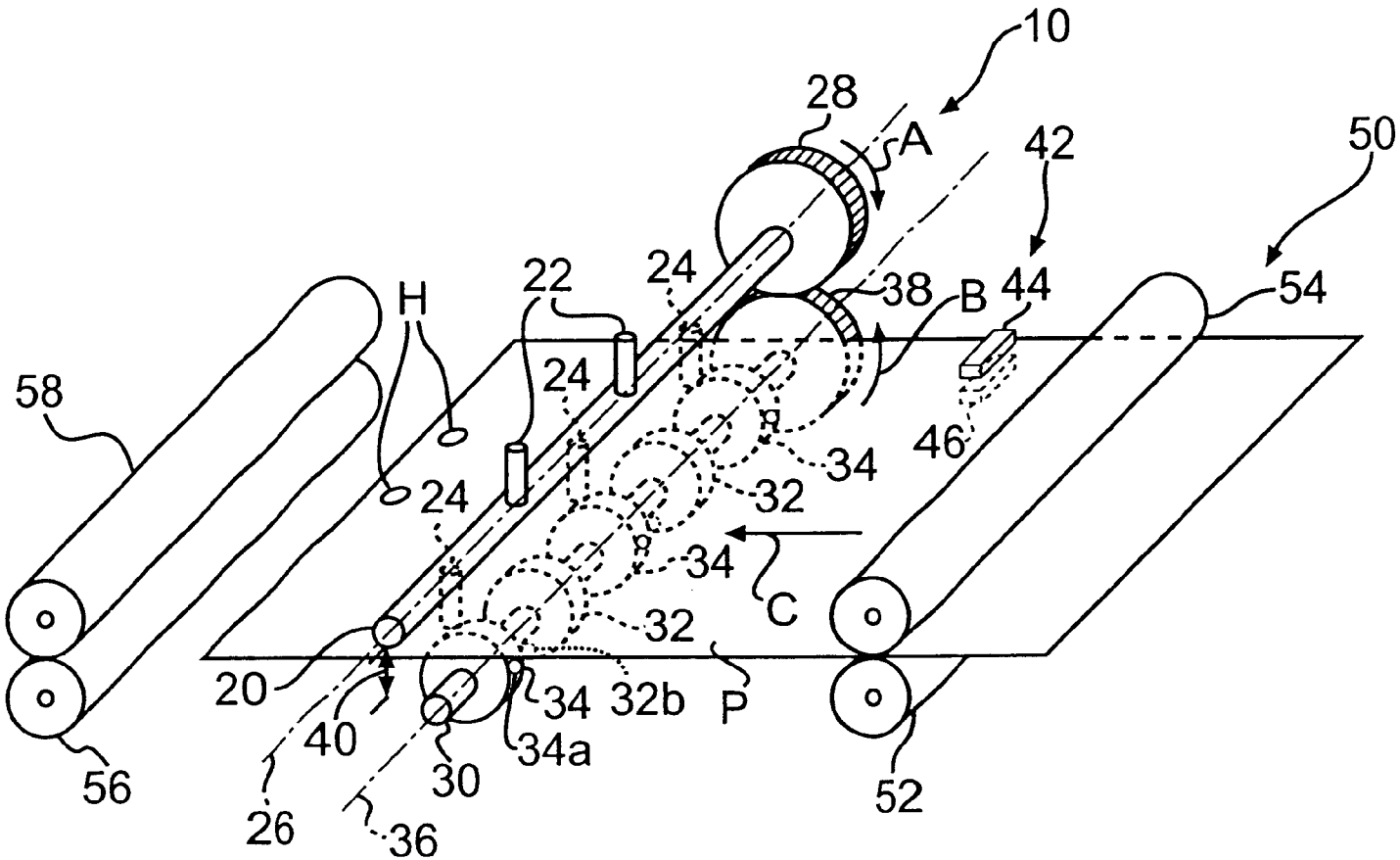
FIG. 1 is a perspective view of the punching and conveying units of a first embodiment of the hole forming device of the present invention.
Figure 2:
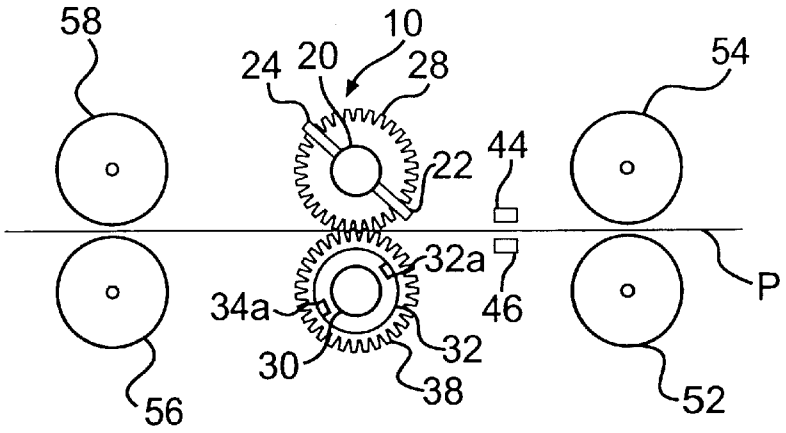
FIG. 2 is an elevational view of the first embodiment of the present invention.

Referring to FIGS. 1 and 2, the punching unit 10 of the hole forming device of the present invention is shown. Although the embodiment shown in FIGS. 1 and 2 can select from two- or three-hole punching, the invention is not limited to these numbers. Punching unit 10 includes a punching shaft 20 including two sets of integral punching studs 22, 24. Studs 22, 24 extend radially from punching shaft 20, with their distal ends including a cutting edge similar to that used in known punching devices. The first set of studs 22 includes two parallelly extending studs, whereas the second set of studs 24 includes three studs. Studs 22 are preferably diametrically opposed to studs 24 and studs 22, 24 are disposed alternatingly along shaft 20 as shown in FIG. 1. Punching shaft 20 is rotatable about axis 26.

Punching unit 10 further includes a die shaft 30 disposed parallel to punching shaft 20 and including two sets of cylindrical die rollers 32, 34, each having one recess 32*a*, 34*a*. The first set of die rollers includes two rollers 32 and two recesses 32*a*, which are complementary to the first set of punching studs 22. The second set of die rollers includes three rollers 34 and three recesses 34*a* complementary to the three punching studs 24. Punching shaft 20 and die rollers 32, 34 are separated by a sufficient gap 40 such that when the two shafts are rotated, punching studs 22 can freely engage with recesses 32*a* and punching studs 24 can freely engage with recesses 34*a*.

Die rollers 32, 34 do not necessarily require recesses formed therein. Any type of surface that cooperates with studs 22, 24 to form holes in media can be used. For example, die rollers 32, 34 can be provided with a resilient yet durable surface upon which studs 23, 24 are pressed.

To maintain synchronism between punching shaft 20 and die shaft 30 so that punching studs 22, 24 will reliably engage with recesses 32*a*, 34*a* with each rotation of the shafts, shaft 20 is provided with a gear 28 that meshes with a gear 38 that is attached to die shaft 30. A stepper motor 70 (see FIG. 3) drives punching shaft 20 in the direction of arrow A, which, in turn, synchronously drives die shaft 30 through gears 28 and 38 in the direction of arrow B. Any medium, such as a sheet of paper P, fed between shafts 20, 30, as they rotate will have two or three holes formed therein as punching studs 22, 24 engage recesses 32*a*, 34*a* through the medium.

Although shafts 20, 30 are driven through full gears 28, 38 in the preferred embodiment, the invention is not limited to this design. For example, the shafts can be driven by belts or gear segments.

Media such as paper sheet P are fed to and from punching unit 10 in the direction of arrow C by a conveying unit 50. Conveying unit 50 can include a supply roller 52 driven by a stepper motor 74 (FIG. 3), and a complementary pinch roller 54. Media are conveyed from punching unit 10 by discharge roller 56, also driven by an unshown stepper motor, and a complementary pinch roller 58.

A sensor 42 is disposed between conveying roller 52 and punching unit 10. Sensor 42 can be an optical sensor, for example, including a light emitting element 44 that emits a light beam and a light receiving element 46 that receives the light beam. When the leading edge of the medium P conveyed by rollers 52, 54 passes between the light emitting and receiving elements 44, 46, the light beam is broken, thus indicating that the leading edge of the medium has reached the sensor.

The position of the sensor is not limited to that shown in the preferred embodiment. For example, the sensor can be positioned downsteam of the punching unit if holes are to be punched in the margin adjacent the trailing edge of the medium. Also, the sensor can be used to detect the trailing edge of the medium so long as the timing between sensing and punching is accurately controlled. The invention is also not limited to an optical sensor; mechanical switches can be used, for example.

Figure 3:
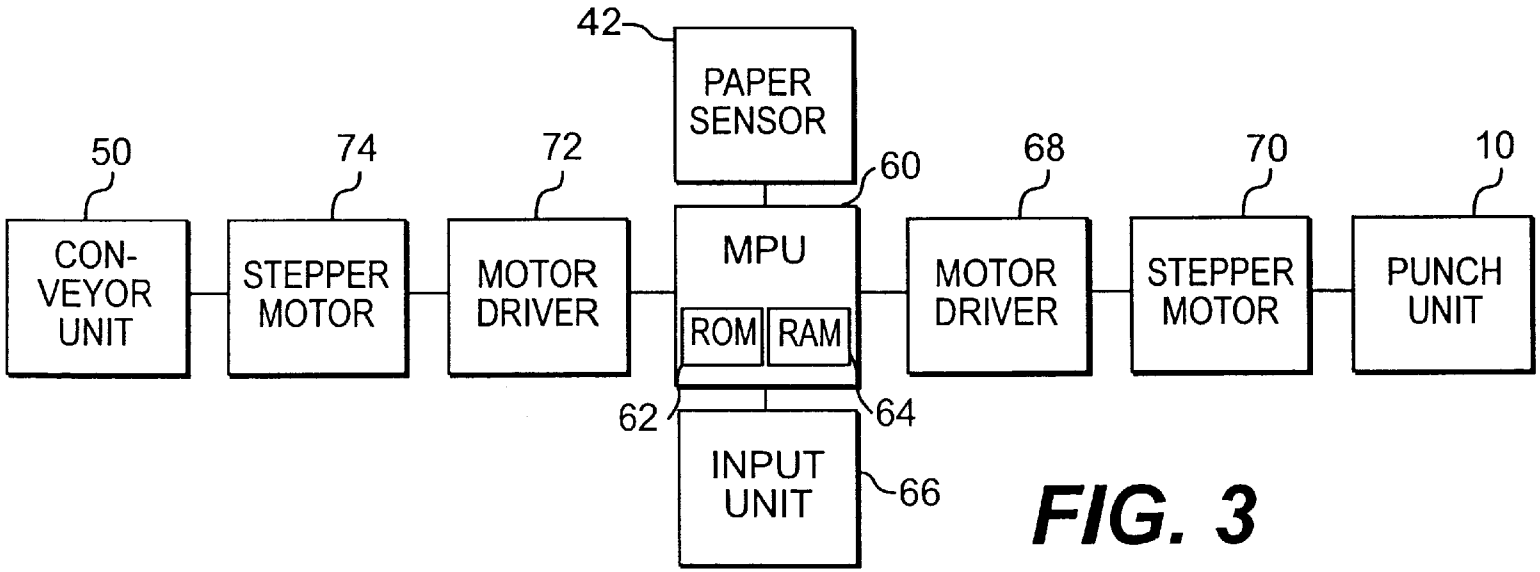
FIG. 3 is schematic view of the hole forming device of the present invention.

Punching unit 10 and conveyor unit 50 are controlled by a control section as shown in FIG. 3. The control section includes a microprocessor unit 60 including a ROM 62 for storing a control program and a RAM 64 used as a work area. An input unit 66 can include a key pad, for example, and inputs to MPU 60 hole punching information, such as the number and locations of holes to be formed in the media. MPU 60 controls a motor driver 72 for controlling stepper motor 74 for driving conveyer unit 50. MPU 60 also controls a motor driver 68 for driving stepper motor 70 for rotating punch shaft 20 of punching unit 10.

Based on the number of holes requested by input unit 66, MPU 60 controls motor driver 68 to drive stepper motor 70 either to index the first set of punching studs 22 and the first set of die rollers 32 to a ready position to form two holes in the medium, or to index the second set of punching studs 24 and die rollers 34 to the ready position in order to form three holes in the medium. As MPU 60 controls conveyor unit 50 to feed the medium P to the punching unit, sensor 42 signals MPU 60 when the leading edge of the medium has reached the sensor. Based on this signal, MPU 60 controls punching unit 10 based on the speed of the conveyed medium to punch the desired number of holes in the medium by controlling rotation of punching shaft 20 and die shaft 30 as the desired position of the medium reaches punching unit 10. As shown in FIG. 1, two holes H have been formed in the top margin of medium P. The speed of punching shaft 20 is controlled such that the rotating speed of the ends of punching studs 22, 24 as they engage recesses 32*a*, 34*a* through the medium is the same as the conveyed speed of the medium, so as not to disrupt the conveyance speed of the medium.

After the holes are punched in the medium and one set of punching studs 22 or 24, withdraws from the corresponding set of recesses 32*a* or 34*a*, MPU 60 controls motor driver 68 to cease rotating the shafts 20, 30 so that the subsequent set of punching studs and recesses will not engage the medium. After the trailing edge of the medium P has passed through the punching unit by conveyance of discharging rollers 56, 58, the shafts of punching unit 10 can either be forwardly or reversely rotated to their original positions.

In the first embodiment, the medium P is preferably fed with the leading edge being the edge adjacent the margin in which the holes are to be formed. For example, if 8½×11 size paper is to be punched, the edge of the left margin is conveyed as the leading edge so that three holes can be formed therein. If legal size paper is to be punched, the edge of the top margin is conveyed as the leading edge so that two holes can be formed therein, as shown in FIG. 1.

If the hole forming apparatus is incorporated in an image forming apparatus, such as a printer or a copier, punching unit 10 can be disposed immediately upstream of the discharge tray or sorter in the conveying direction of the medium. MPU 60 can be used to control both the hole forming operations and image forming or copying operations. Input unit 66 can be incorporated into the control panel of the image forming apparatus. Thus, recording media having images formed thereon can be discharged and collated with the desired holes already punched therein.

Figure 4:
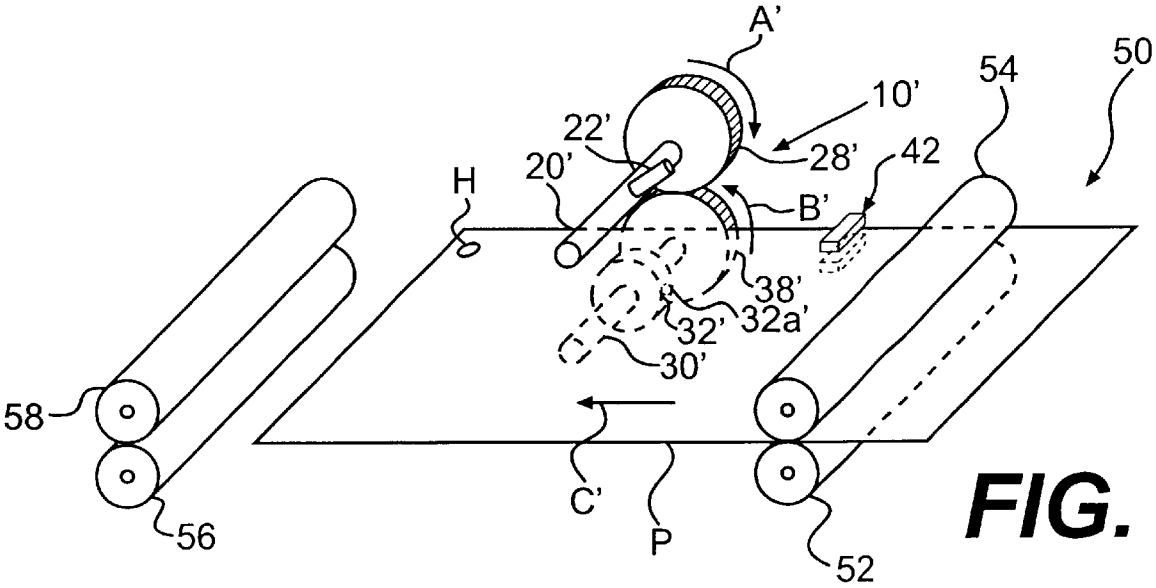
FIG. 4 is a perspective view of the punching and conveying units of a second embodiment of the hole forming device of the present invention.
Figure 5:
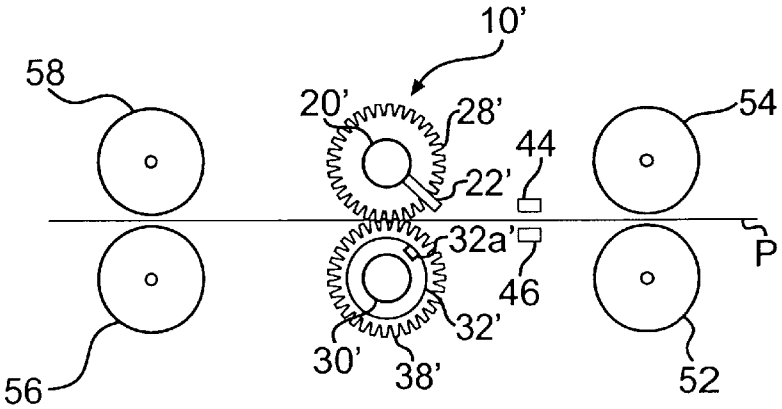
FIG. 5 is an elevational view of the second embodiment of the present invention.

A second embodiment of the present invention is shown in FIGS. 4 and 5. The control of the second embodiment is similar to that shown in FIG. 3. Punching unit 10' of the second embodiment includes a punching shaft 20' and die shaft 30' as in the first embodiment, but only one punching stud 22' and one die roller 32' and complementary recess 32*a*' are provided thereon. In this embodiment, media P are conveyed through punch unit 10' in the direction of the arrow with the edge adjacent the margin in which the holes are to be formed being parallel to the conveyance direction. For example, with 8½×11 paper, the edge of the top margin of the medium is conveyed as the leading edge so that holes can be formed in a side margin as shown in FIG. 4.

In the second embodiment, the single punching stud 22' and complementary recess 32*a*' are used to form all of the desired holes in the medium. If two holes are requested through input section 66, then punching and die shafts 20', 30' are rotated twice as the medium is conveyed through punching unit 10'. If three holes are requested, the shafts are rotated three times at calculated timings as the medium is conveyed through punching unit 10'.

As MPU 60 controls conveyer unit 50 to convey the medium, sensor 42 signals to MPU 60 when the leading edge of the medium has reached the sensor. MPU 60 then calculates the timing at which the location of the first hole reaches the punching position and controls punching and die shafts 20', 30' to rotate and form a hole at that precise location. Punching and die shafts 20', 30' continue to rotate until punching stud 22' and recess 32*a*' are at the index position ready to form the next hole. MPU 60 calculates the timing at which the location for the second hole in the medium reaches the punching position and then drives the punching unit once more to form the second hole. If three or more holes are selected, MPU 60 calculates the precise timing to actuate punching unit 10' to form those subsequent holes. The number of holes to be formed by the second embodiment is not limited and can range from one to any integer number.

Punching shaft 20' does not need to rotate at a constant rotational speed throughout the punching operation. The only requirement is that the speed of the end of punching stud 22' moves at the same speed as the medium when it is contacting the medium, so as not to hinder conveyance of the medium. Therefore, punching shaft 20' can be controlled to rotate at variable speeds through a full 360° rotation, as long as it rotates at a predetermined speed while punching stud 22' contacts the medium.

While the present invention has been described as to what is currently considered to be the preferred embodiments, it is to be understood that the invention is not limited to them. To the contrary, the invention is intended to cover various modifications and equivalent arrangements within the spirit and scope of the appended claims. For example, the punching studs and recesses need not be provided on rotating shafts, but can be provided on opposing platens that are controlled to move toward one another as well as parallel to one another in a direction along the conveyance direction of the medium. Also, the features of the first and second embodiments can be combined such that two punching shafts are provided: a shaft with two punching studs on one side thereof and a shaft with a single punching stud that is axially offset from the two punching studs. The shaft with the set of two punching studs can be used when two holes are to be formed in the top margin of the media and the shaft with the single punching stud can be used to form one or more holes in the side margin. The scope of the following claims is to be accorded the broadest interpretation so as to encompass all such modifications and equivalent structures and functions.

We claim:

1. An apparatus for forming a number of holes in a medium, said apparatus comprising:

a punching unit for forming the holes in the medium, said punching unit including a punching roller having at least first and second sets of aligned punching studs and a parallel die roller having at least first and second sets of aligned recesses complementary to said first and second sets of punching studs, respectively, said first set of punching studs numbering a first predetermined number and said second set of punching studs numbering a second predetermined number;

a selector selecting whether to form the first predetermined number or the second predetermined number of holes in the medium; and a controller controlling said punching unit based on the number of holes selected by said selector, said controller controlling said punching roller and said die roller to rotate with said first set of punching studs engaging said first set of recesses through the medium to form the first predetermined number of holes in the medium when the first predetermined number is selected, and to rotate with said second set of punching studs engaging said second set of recesses through the medium to form the second predetermined number of holes in the medium when the second predetermined number is selected.

2. The apparatus according to claim 1, further comprising a conveyor conveying the medium, said controller controlling said conveyor to convey the medium to said punching unit.

3. The apparatus according to claim 2, wherein when said punching studs of said punching roller are not engaged with said recesses of said die roller, a gap is present between said punching roller and said die roller through which said conveyer conveys the medium.

4. The apparatus according to claim 2, further comprising a sensor for sensing a position of the medium conveyed by said conveyor, said controller controlling said punching unit to operate at a timing based on an output from said sensor.

5. The apparatus according to claim 2, wherein said controller controls said punching and die rollers to rotate and to contact the medium at a same speed as said conveyor conveys the medium.

6. The apparatus according to claim 2, wherein based on the number selected by said selector, said controller controls said punching and die rollers to rotate such that said first sets of punching studs and recesses or said second sets of punching studs and recesses are positioned at ready positions adjacent a conveying path of the medium.

7. The apparatus according to claim 6, wherein after said punching unit forms holes in the medium and the trailing end of the medium is conveyed past said punching unit, said controller controls said punching and die rollers to rotate such that one of said first and second sets of punching studs and recesses are positioned at the ready positions before a next medium is conveyed to said punching unit.

8. The apparatus according to claim 1, wherein said punching unit forms the holes in a margin of the medium.

9. The apparatus according to claim 1, wherein said punching roller rotates synchronously with said die roller.

10. The apparatus according to claim 9, wherein said punching roller and said die roller each comprise engaging gears to effect synchronous rotation.

11. The apparatus according to claim 1, wherein the first predetermined number is two and the second predetermined number is three.

12. The apparatus according to claim 1, wherein said hole forming apparatus is incorporated in an image forming apparatus.

13. An apparatus for forming a number of holes in a medium, said apparatus comprising:

selecting means for selecting the number of holes to be formed in the medium, the number of holes being selected from at least two predetermined numbers;

hole forming means for forming the holes in the medium, said hole forming means comprising a rotatable shaft having a first set of aligned punches on one side thereof and a second set of aligned punches on another side thereof, the number of punches in the first set equaling one of the at least two predetermined numbers and the number of punches in the second set equaling another of the at least two predetermined numbers; and control means for controlling said hole forming means to form in the medium the number of holes selected by said selecting means.

14. An apparatus for forming a number of holes in a medium, said apparatus comprising:

a punching section for forming the holes in the medium, said punching section including a punching device having at least first and second sets of aligned punches positioned on different sides of a shaft, said first set of punches numbering a first predetermined number and said second set of punches numbering a second predetermined number;

a selector selecting whether to form the first predetermined number or the second predetermined number of holes in the medium; and a controller controlling said punching section based on the number of holes selected by said selector, said controller controlling said punching section to force said first set of punches through the medium to form the first predetermined number of holes in the medium when the first predetermined number is selected, and to force said second set of punches through the medium to form the second predetermined number of holes in the medium when the second predetermined number is selected.

15. The apparatus according to claim 14, further comprising a conveyor conveying the medium, said controller controlling said conveyor to convey the medium to said punching section.

16. The apparatus according to claim 15, further comprising a sensor for sensing a position of the medium conveyed by said conveyor, said controller controlling said punching section to operate at a timing based on an output from said sensor.

17. The apparatus according to claim 14, wherein said punching section forms the holes in a margin of the medium.

18. The apparatus according to claim 14, wherein the first predetermined number is two and the second predetermined number is three.

19. The apparatus according to claim 14, wherein said hole forming apparatus is incorporated in an image forming apparatus.

* * * * *